United States Patent [19]

Moore

[11] Patent Number: 4,708,691

[45] Date of Patent: Nov. 24, 1987

[54] STRUCTURAL BEAM AND BLANK FOR FORMING IT

[76] Inventor: Robert L. Moore, 424 Great Elm Way, Acton, Mass. 01718

[21] Appl. No.: 916,204

[22] Filed: Oct. 7, 1986

[51] Int. Cl.[4] ..... A63H 33/00; A63H 33/08

[52] U.S. Cl. ..... 446/488; 446/106

[58] Field of Search ..... 446/488, 487, 106

[56] References Cited

U.S. PATENT DOCUMENTS

| | | | |
|---|---|---|---|
| 1,258,086 | 3/1918 | Bennett . | |
| 1,533,011 | 4/1925 | Knaggs . | |
| 2,075,259 | 3/1937 | Battjes . | |
| 2,751,705 | 6/1956 | Joseph | 446/488 X |
| 2,832,100 | 4/1958 | Swallert . | |
| 2,874,512 | 2/1959 | Joseph et al. | 446/487 X |
| 2,946,150 | 7/1960 | Houk | 446/488 X |
| 3,066,436 | 12/1962 | Schuh . | |
| 3,368,316 | 2/1968 | Crowder | 446/106 X |
| 3,581,431 | 6/1971 | Trenovan | 446/488 X |
| 4,523,418 | 6/1985 | McLaughlin . | |

*Primary Examiner*—Philip C. Kannan

*Attorney, Agent, or Firm*—Hamilton, Brook, Smith & Reynolds

[57] ABSTRACT

A three dimensional reinforced structural beam and a blank from which it is made is disclosed. It has a rectangular bottom (2), parallel wall portions (4) and (8), rectangular top portions (12) and (16), and two parallel rectangular rib portions (20) and (24). The beams may be provided with notches (32) and (34), and a tab 50 and slot 54 to facilitate assembly.

14 Claims, 9 Drawing Figures

STRUCTURAL BEAM AND BLANK FOR FORMING IT

FIELD OF THE INVENTION

This invention relates to three dimensional, reinforced, structural beams and blanks for forming them.

BACKGROUND OF THE INVENTION

For a considerable period of time, there has been a market for easily assembled and disassembled objects which may be formed from flat sheets of chip board, corrugated board and the like. Inexpensive household furniture, such as storage cabinets, particularly for clothing, have been formed by flat panels secured together by fasteners. Children's playhouses and the like have been formed from interlocking sheets without fasteners.

These types of products have a number of advantages. Since they are made from flat panels, which are generally boxed and sold in cartons, there is a substantial saving in space, the unassembled components naturally occupying substantially less space than the assembled product. The products are generally lightweight, easily assembled and disassembled, and are inexpensive.

A major disadvantage, however, is that objects made from two dimensional, flat panels generally lack structural rigidity. They can readily be bent, the panels frequently come apart, unless permanently secured together, and they generally will not support much weight.

Examples of this type of construction will be found in the U.S. Pat. Nos. 1,258,086; 1,533,011; 2,075,259; 2,832,100; and 4,523,418, spanning a period of almost 70 years.

It is an object of this invention to provide three dimensional, rather than two dimensional, structural beams for objects such as playhouses and articles of household furniture which are made from flat panels.

Another object of this invention is to provide blanks for fabricating three dimensional structural beams which blanks may be manufactured from flat stock, pre-cut and scored while still flat, and shipped and sold, while still flat and unassembled.

Yet another object of the invention is to provide blanks for assembly into three dimensional structural members which require no independent securing means.

SUMMARY OF THE INVENTION

The invention resides in a blank which is cut and scored to form a three dimensional, reinforced structural beam when it is folded, as well as the beam formed from the blank. The blank has a rectangular bottom portion and first and second rectangular wall portions joined along parallel scored or creased edges of the bottom. First and second rectangular top portions are joined to the wall portions along parallel opposite edges. A pair of rectangular rib portions are joined to parallel scored or creased edges of the top portions. All of the edges are parallel to each other.

The beam may be either notched or unnotched, depending upon the purpose for which it is intended. At least one notch section is formed in the blank by a pair of spaced, parallel incisions which extend through the bottom, a rectangular wall portion and a rectangular top portion. The incisions are formed at right angles to the edges which join the portions together.

A tab may be formed in one of the rectangular rib members at the scored or creased edge which joins it to the contiguous top portion. A slot is formed to receive the tab at the scored or creased edge joining the opposite rectangular rib member to its contiguous rectangular top portion.

The blanks, either notched or unnotched, are folded into a rectangular, three dimensional cross-section wherein the wall portions extend upwardly at right angles from the bottom, the top portions are parallel to the bottom and spaced therefrom, and the rib members extend downwardly from the top portions to the bottom. The rib members are parallel and contiguous with each other and serve as internal strengthening ribs to the assembled beam.

If a tab is employed, it is inserted into the notch to assist in holding the beam in its assembled rectangular form.

One or more notches are formed in the beams by bending the incised areas inwardly so that a vertical member extends parallel to the rib members and is joined at its upper and lower edges to upper and lower extenders respectively, which lie parallel to, and in engagement with the bottom and the top portion of the beam.

The unnotched beams are assembled by inserting them in openings made in beams of like construction, but of larger dimension. The notched beams are assembled in the manner that log cabins are assembled with the notch of each beam engaging a mating notch of a beam directly above or directly below it in parallel relationship.

The above and other features of the invention including various novel details of construction and combinations of parts will now be more particularly described with reference to the accompanying drawings and pointed out in the claims. It will be understood that the particular Reinforced Beam and Blank for Forming It embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figure 1:
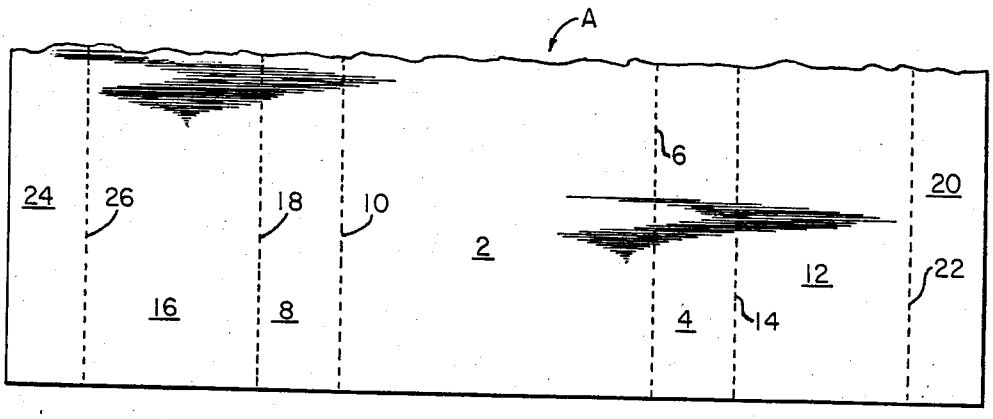
FIG. 1 is a blank, cut and scored to form, when folded, a three dimensional reinforced structural beam without notches.
Figure 2:
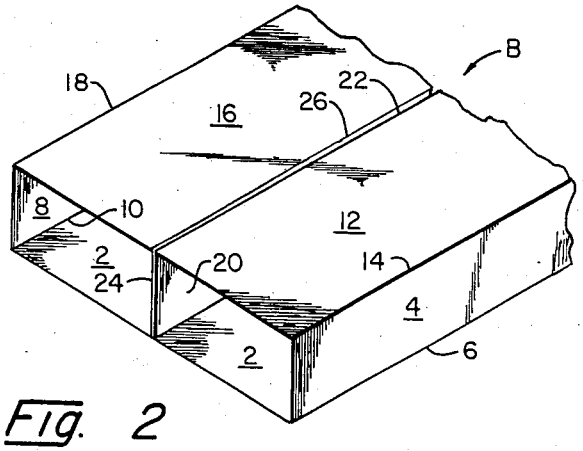
FIG. 2 is a three dimensional reinforced structural beam formed from the blank shown in FIG. 1.
Figure 3:
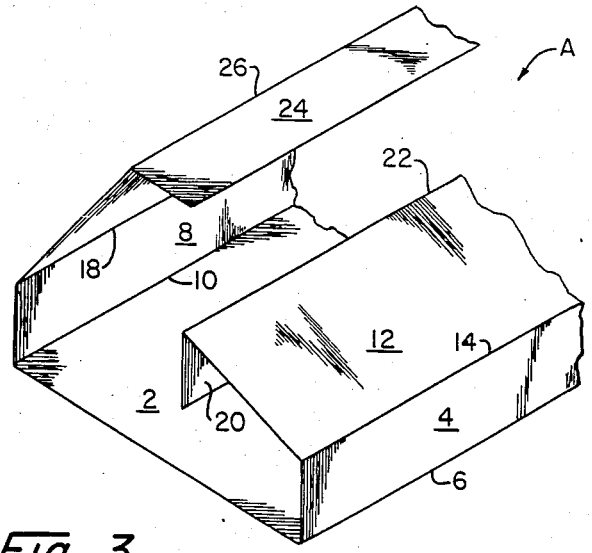
FIG. 3 is the blank of FIG. 1 in the process of being folded.
Figure 4:
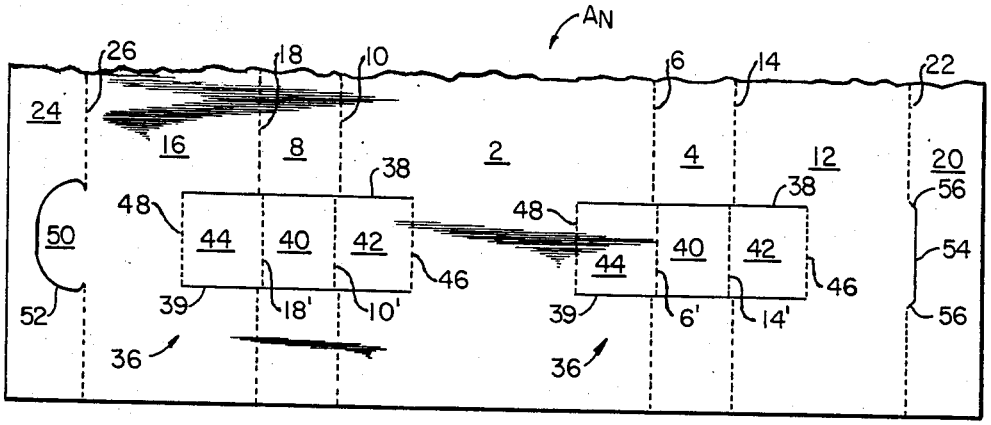
FIG. 4 is a blank, cut and scored to form, when folded, a three dimensional reinforced structural beam having notches.
Figure 5:
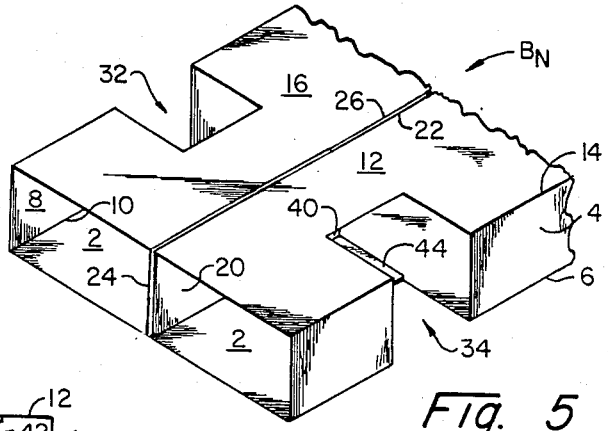
FIG. 5 is a reinforced structural beam formed from the blank shown in FIG. 4.

FIG. 1 shows a blank A, cut and scored to form a three dimensional reinforced structural beam when it is folded. Only a portion of the blank and the beam made from it are shown in FIGS. 1 through 3, but it will be understood that the blank A may be from approximately 4 inches long to approximately 6 feet in length, depending upon what the beam is going to be used for.

The blank A includes a rectangular bottom 2 and a first rectangular wall portion 4, joined along one scored edge 6 of the bottom. A second rectangular wall portion 8 is joined along a second opposite scored edge 10 of the bottom.

A first rectangular top portion 12 is joined along a scored edge 14 of the first rectangular wall 4. A second rectangular top portion 16 is joined along a scored edge 18 of the second rectangular wall. A first rectangular rib portion 20 is joined along a scored edge 22 of the first rectangular top portion 12 and a second rectangular rib portion 24 is joined along a scored edge 26 to the second rectangular top portion 16.

All of the edges 6, 10, 14, 22 and 24 are parallel to each other and are formed by creasing or scoring the blank A, depending upon the material from which the blank was made. The score crease lines may be formed partially through the blank A.

Whereas the blank A may be made of any suitable stiff chipboard cardboard, or even metal, it has been found that corrugated board is ideally suitable from a structural standpoint and is relatively inexpensive for this purpose.

The blank A is shown in FIG. 3 in the process of being folded with like reference characters illustrating each portion of the blank.

The resulting three dimensional reinforced structural beam B is shown (in far shortened form in FIG. 2). The rectangular bottom 2 is joined to the first rectangular wall 4 along the edge 6, the wall 4 extending upwardly at a right angle from the bottom. In like manner, the second rectangular wall 8 extends upwardly at a right angle from the bottom 2. The first rectangular top portion 12, which is joined to the wall portion 4 along the edge 14, extends parallel to the bottom 2, as does the second rectangular top portion 16. The first and second rectangular rib members 20 and 24 extend downwardly from their respective top portions toward the bottom 2.

The rib members 20 and 24 constitute a central reinforcement for the beam B, affording resistance to its bending, as well as to compressive forces normal to the top and/or the bottom.

The top portions 12 and 16 are not only substantially co-planar, but their areas are substantially equal, whereby the rib members 20 and 24 are located substantially midway between the wall members 4 and 8. In cross section, the beam B is three dimensional and rectangular, the walls 4 and 8 and the rib portions 20 and 24 being parallel, and the top portions 12 and 16 being parallel to the bottom 2.

Figure 9:
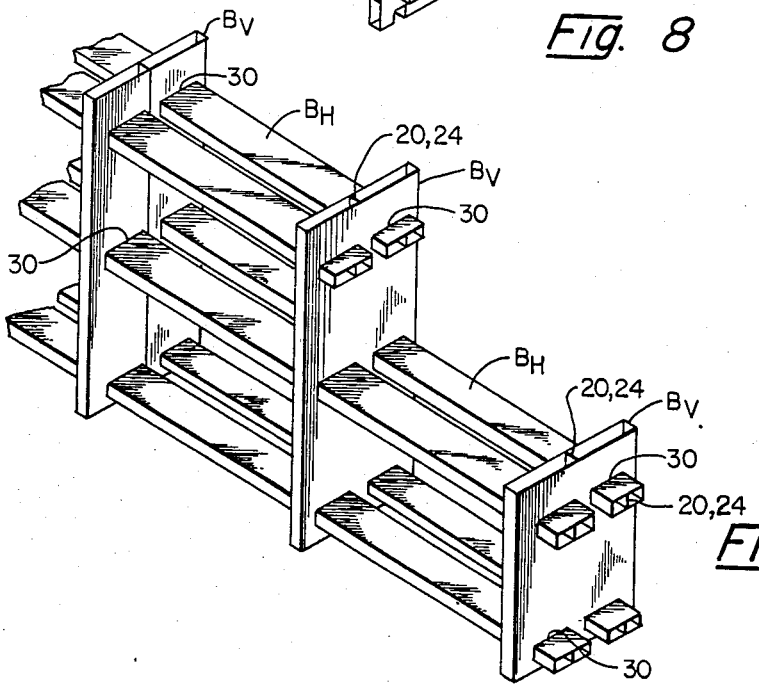
FIG. 9 is a perspective view of a bookcase formed of unnotched beams of the type shown in FIG. 2.

Referring next to FIG. 9, there will be seen a bookcase made of reinforced structural beams B as hereinabove described. The bookcase is made up of horizontal beams $B_h$, which may be of any desired length, and vertical beams $B_v$ made in an identical manner to the horizontal beams $B_h$, but are substantially wider. Rectangular holes 30 are formed in the vertical beams $B_v$ and are of a size just slightly larger than the cross-sectional rectangular size of the horizontal beams $B_h$. The holes 30 may be formed at any desired location, depending upon the configuration desired by the person assembling the bookcase, or they may also be pre-cut, at the factory, in the blanks from which the vertical beams $B_v$ are formed.

The horizontal beams $B_h$ are inserted in the holes 30. Therein they are confined in rectangular cross-sectional form and will not collapse. Conversely, the presence of the horizontal beams $B_h$ within the holes 30 in the vertical beams, maintains the cross-section of the vertical beams $B_v$ also rectangular. A bookcase formed of beams made in accordance with this invention will support the weight of books or other objects completely filling the shelves made from the horizontal beams $B_h$ without collapsing or tipping.

The bookcase shown in FIG. 9 is illustrative of but one object which can be made with the three dimensional reinforced structural beams of this invention. Numerous and other articles of furniture can be made in this manner.

Another version of the reinforced structural beam will be seen in FIGS. 4 through 7. This blank, designated $A_n$, is similar to the beam shown in FIGS. 1 to 3, but includes one or more notches 32, 34. Like reference characters are used to describe parts which are identical to those in the FIG. 1 to 3 embodiment. There is at least one notch section 36 formed in the blank $A_n$ by a pair of spaced, parallel incisions 38 and 39. They extend through the bottom 2, a rectangular wall 4 (and/or 8) and a rectangular top portion 12 (and/or 16). The incisions are formed at right angle to the edges 6, 10, 14, and 18, which join the bottom 2, the rectangular wall portions 4 and 8 and the rectangular top portions 12 and 16.

The incisions 38 and 39, combined with the scored or creased edges 6, 10, 14 and 18 define rectangular panels which, when folded, become a vertical member 40 and upper and lower extenders 42 and 44. The ends of the incisions are joined by scores or creases 46 and 48 to assist in folding. Also to assist in folding, the score or crease lines, in the notch sections 36 may be slightly offset as shown at 6', 10' 14' and 18'.

Figure 6:
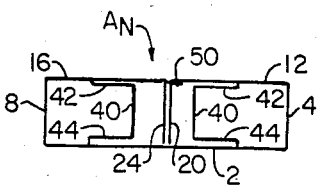
FIG. 6 is an end view, on reduced scale, of the beam shown in FIG. 5.
Figure 7:
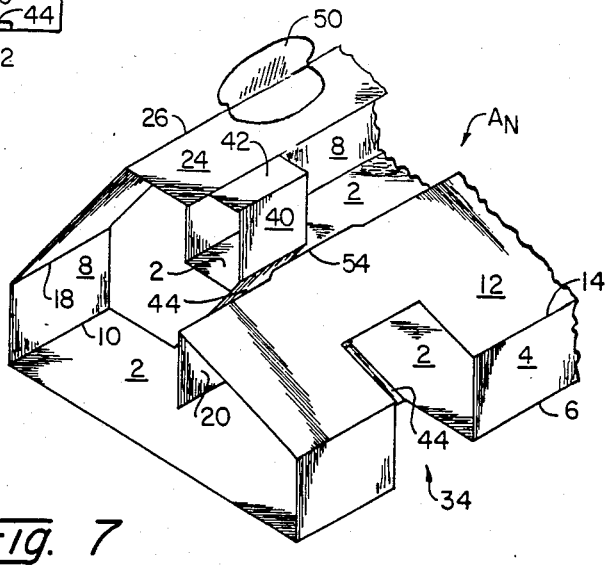
FIG. 7 is a perspective view of the blank shown in FIG. 4 being folded into a structural beam.

Each notch 32 and/or 34 is formed while the beam is being folded, as shown in FIG. 7, by bending the vertical member 40 and the upper and lower extenders 42 and 44 inwardly of the beam $B_n$, so that in cross-section they assume the configuration shown in FIG. 6. The vertical member 40 extends parallel to the rib members 20 and 24, and the upper and lower extenders 42 and 44 lie parallel to and in substantial engagement with the bottom 2 and a top portion 12 or 16, respectively. Since the vertical members 40 are parallel to the rib members 20 and 24, they too, offer structural rigidity.

If desired, the reinforced structural beam, either without notches as shown in FIGS. 1 through 3 or with notches as shown in FIGS. 4 through 7, may be provided with a tab 50 which is formed from a portion of the second rectangular rib member 24, by an arcuate incision 52 at the edge 26, which joins the second rectangular rib member 24 to the second rectangular top portion 16.

A receiving slot 54 is formed at the edge or crease 22 which joins the first rectangular rib member 20 to the first rectangular top portion 12. The slot 54 may be offset slightly as shown at 56 to facilitate assembly. On assembly, the tab 50 is inserted into the slot 54, which helps in maintaining the notched reinforced structural beam in rectangular cross-section. As with the unnotched beams B, the beams $B_n$ with notches may be of any desired length.

Figure 8:
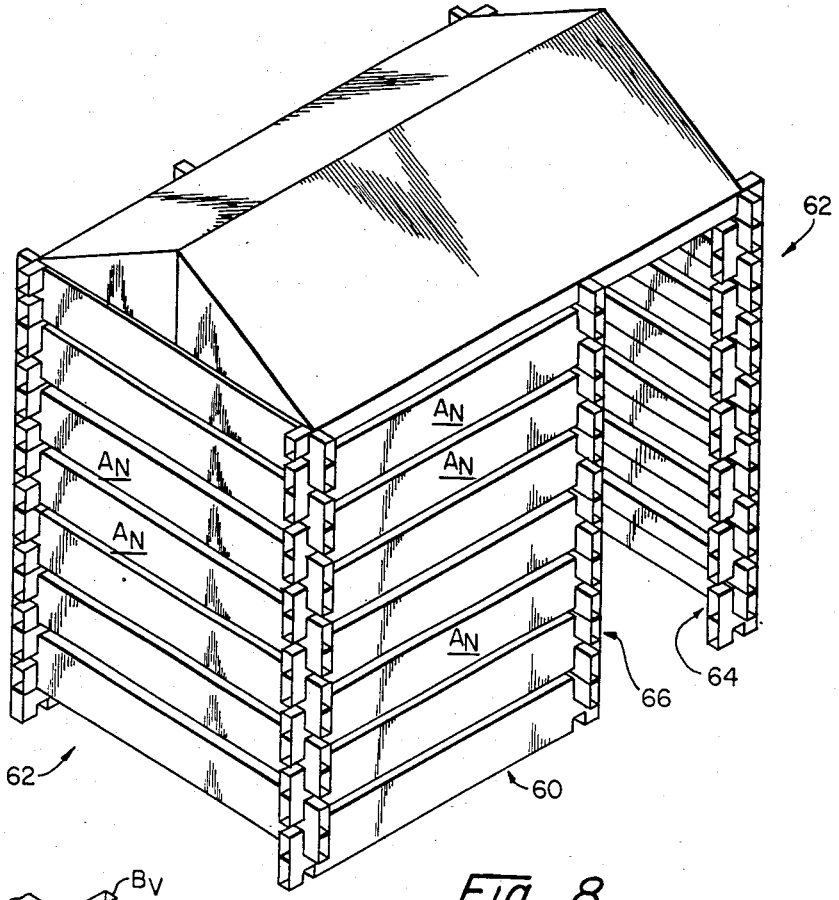
FIG. 8 is perspective view of a children's playhouse made of the notched type structural beam of the type shown in FIG. 5.

A children's playhouse is illustrated in FIG. 8, and includes beams $A_n$ of one length forming a front wall 60. Beams $A_n$ of a different length may be employed to form side walls 62. Beams of yet another length may be used to form a front panel 64 adjacent to a door opening. Additional beams of a short size form a short wall 66, bordering the door opening.

Whereas the unnotched beams B, which were illustrated in the bookcase shown in FIG. 9, were inserted in rectangular slots 30 in vertical beams, the notched beams $B_n$ are assembled one above another with their faces in parallel and with the notches 32, 34 of two adjacent beams fitting within each other in the manner of construction of a log cabin.

I claim:

1. A three dimensional, reinforced, structural beam formed from one piece of sheet material comprising:

a rectangular bottom, a first rectangular wall joined along one edge of the bottom and extending upwardly at a right angle from the bottom, a second rectangular wall joined along a second opposite edge of the bottom and extending upwardly at a right angle from the bottom, a first rectangular top portion joined along an edge of the first rectangular wall and extending parallel to the bottom, a second rectangular top portion joined along an edge of the second rectangular wall and extending parallel to the bottom, a first rectangular rib member joined along an edge of the first rectangular top portion and extending at a right angle, downwardly from the first rectangular top portion toward the bottom, a second rectangular rib member joined along an edge of the second rectangular top portion and extending at a right angle, downwardly from the second rectangular top portion toward the bottom, at least one notch in a rectangular wall, at least one member associated with each notch offering structural rigidity between the top and the bottom comprising:

a piece of the rectangular wall contiguous with a piece of the top and a piece of the bottom, each folded inwardly on itself to form together a single, substantially U-shaped member including a single member positioned parallel to the rib members and extending between the top and the bottom and integrally joined to upper and lower extenders lying parallel to and in engagement with the top and the bottom portions respectively.

2. A three dimensional, reinforced, structural beam according to claim 1, wherein the top portions are substantially co-planar.

3. A three dimensional, reinforced, structural beam according to claim 1, wherein the first and second rectangular walls are parallel.

4. A three dimensional, reinforced, structural beam according to claim 1, wherein the rib members are parallel to the wall members.

5. A three dimensional, reinforced, structural beam according to claim 1, wherein the rib members are contiguous with each other.

6. A three dimensional, reinforced, structural beam according to claim 1, wherein the areas of the top portion are substantially equal.

7. A three dimensional, reinforced, structural beam according to claim wherein the rib members are located substantially midway between the wall members.

8. A three dimensional, reinforced, structural beam according to claim 1, wherein a tab is formed in the second rectangular rib member at the edge joining the second rectangular rib member to the second rectangular top portion and a slot to receive the tab is formed at the edge joining the first rectangular rib member to the first rectangular top portion.

9. A three dimensional, reinforced, structural beam formed from one piece of sheet material comprising:

a rectangular bottom, a first rectangular wall joined along one edge of the bottom and extending upwardly at a right angle from the bottom, a second rectangular wall joined along a second opposite edge of the bottom and extending upwardly at a right angle from the bottom, a first rectangular top portion joined along an edge of the first rectangular wall and extending parallel to the bottom, a second rectangular top portion joined along an edge of the second rectangular wall and extending parallel to the bottom, a first rectangular rib member joined along an edge of the first rectangular top portion and extending at a right angle, downwardly from the first rectangular top portion toward the bottom, a second rectangular rib member joined along an edge of the second rectangular top portion and extending at a right angle, downwardly from the second rectangular top portion toward the bottom, at least one notch in a rectangular wall comprising a vertical member extending parallel to the rib members and joined to upper and lower extenders lying parallel to and in engagement with the bottom and a top portion respectively, first and second notches formed, one each in the first and second rectangular walls, at least one member associated with each notch offering structural rigidity between the top and the bottom comprising:

a piece of the rectangular wall contiguous with a piece of the top and a piece of the bottom, each folded inwardly on itself to form together a single, substantially U-shaped member including a single member positioned parallel to the rib members and extending between the top and the bottom and integrally joined to upper and lower extenders lying parallel to and in engagement with the top and the bottom portions respectively.

10. A reinforced structural beam according to claim 10 wherein a tab is formed in the second rectangular rib member at the edge joining the second rectangular rib member to the second rectangular top portion and a slot to receive the tab is formed at the edge joining the first rectangular rib member to the first rectangular top portion.

11. A blank, cut and scored to form a reinforced structural beam when folded, comprising:

a rectangular bottom, a first rectangular wall portion joined along one edge of the bottom, a second rectangular wall portion joined along a second, opposite edge of the bottom, a first rectangular top portion joined along an edge of the first rectangular wall, a second rectangular top portion joined along an edge of the second rectangular wall, a first rectangular rib portion joined along an edge of the first rectangular top portion, a second rectangular rib portion joined along an edge of the second rectangular top portion and, at least one notch section formed by a pair of spaced, parallel incisions extending through the bottom, a rectangular wall portion and a rectangular top portion at right angles to the edges which join the bottom, the rectangular wall portion, and the rectangular top portion, the incised area between the spaced incisions being continuous and intact, and score lines extending between the incisions to permit the incised area to be folded into three parts when the beam is folded.

12. A blank according to claim 11 wherein a tab portion is formed in one of the rib portions at the edge joining the rib portion to its contiguous top portion by an arcuate incision through the blank and a slot to receive the tab is formed at the edge joining the other rib portion to its contiguous top portion.

13. A blank, cut and scored to form a reinforced structural beam when folded, comprising:

a rectangular bottom, a first rectangular wall portion joined along one edge of the bottom, a second rectangular wall portion joined along a second, opposite edge of the bottom, a first rectangular top portion joined along an edge of the first rectangular wall, a second rectangular top portion joined along an edge of the second rectangular wall, a first rectangular rib portion joined along an edge of the first rectangular top portion, a second rectangular rib portion joined along an edge of the second rectangular top portion, first and second notch sections, each section comprising:

a pair of spaced parallel incisions extending through the bottom, a rectangular wall portion and a rectangular top portion at right angles to the edges joining the bottom, the rectangular wall portion, and the rectangular top portion, the incised area between the spaced incisions being continuous and intact, and score lines extending between the incisions to permit the incised area to be folded into three parts where the beam is folded.

14. A blank according to claim 13 wherein a tab portion is formed in one of the rib portions at the edge joining the rib portion to its contiguous top portion by an arcuate incision through the blank and a slot to receive the tab is formed at the edge joining the other rib portion to its contiguous top portion.

* * * * *